US007263839B2

(12) United States Patent
Overweg

(10) Patent No.: US 7,263,839 B2
(45) Date of Patent: Sep. 4, 2007

(54) COOLING DEVICE FOR MR APPARATUS

(75) Inventor: Johannes Adrianus Overweg, Uelzen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 220 days.

(21) Appl. No.: 10/531,348

(22) PCT Filed: Sep. 18, 2003

(86) PCT No.: PCT/IB03/04173

§ 371 (c)(1),
(2), (4) Date: Apr. 15, 2005

(87) PCT Pub. No.: WO2004/036604

PCT Pub. Date: Apr. 29, 2004

(65) Prior Publication Data

US 2006/0137376 A1 Jun. 29, 2006

(30) Foreign Application Priority Data

Oct. 16, 2002 (EP) ..... 02079272

(51) Int. Cl.
*F17C 3/08* (2006.01)
*F25D 23/12* (2006.01)

(52) U.S. Cl. ..... 62/45.1; 62/259.2

(58) Field of Classification Search ..... 62/45.1, 62/49.1, 49.2, 51.1, 467, 259.2; 335/216, 335/300

See application file for complete search history.

(56) References Cited

U.S. PATENT DOCUMENTS

| | | | | |
|---|---|---|---|---|
| 3,166,915 | A | | 1/1965 | Klipping |
| 4,028,905 | A | * | 6/1977 | Andres et al. ..... 62/3.1 |
| 4,332,136 | A | | 6/1982 | Quack |
| 4,872,314 | A | | 10/1989 | Asano et al. |
| 5,293,750 | A | | 3/1994 | Tamura et al. |
| 5,341,059 | A | * | 8/1994 | Fukuyama et al. ..... 310/90.5 |
| 5,379,600 | A | * | 1/1995 | Moritsu et al. ..... 62/47.1 |
| 5,410,286 | A | | 4/1995 | Herd et al. |
| 5,563,566 | A | * | 10/1996 | Laskaris et al. ..... 335/216 |
| 5,644,919 | A | * | 7/1997 | Baker et al. ..... 62/45.1 |
| 5,936,499 | A | | 8/1999 | Eckels |
| 5,979,176 | A | * | 11/1999 | Stables et al. ..... 62/610 |

(Continued)

FOREIGN PATENT DOCUMENTS

EP 0 937 995 A2 8/1999

(Continued)

*Primary Examiner*—Mohammad M. Ali

(57) ABSTRACT

The invention relates to a cooling method for cooling a superconducting coil assembly in a MR apparatus, wherein the superconducting coil assembly 10 is cooled using a cooling agent 41, 42 which is in thermal contact with the superconducting coil assembly in a cooling chamber 20, the cooling agent being cooled by a refrigerator 50. The method comprises the steps of transferring (S2) cooling agent from the cooling chamber to a cooling agent storage when a predetermined temperature is exceeded in at least a part of the cooling agent in the cooling chamber, and returning (S4) cooling agent from the cooling agent storage to the cooling chamber when the temperature of at least a part of the cooling agent in the cooling chamber is equal to or less than the predetermined temperature. The invention also relates to a cooling device for performing the cooling method and to an MR apparatus with such a cooling device.

13 Claims, 4 Drawing Sheets

U.S. PATENT DOCUMENTS

Figure 1:
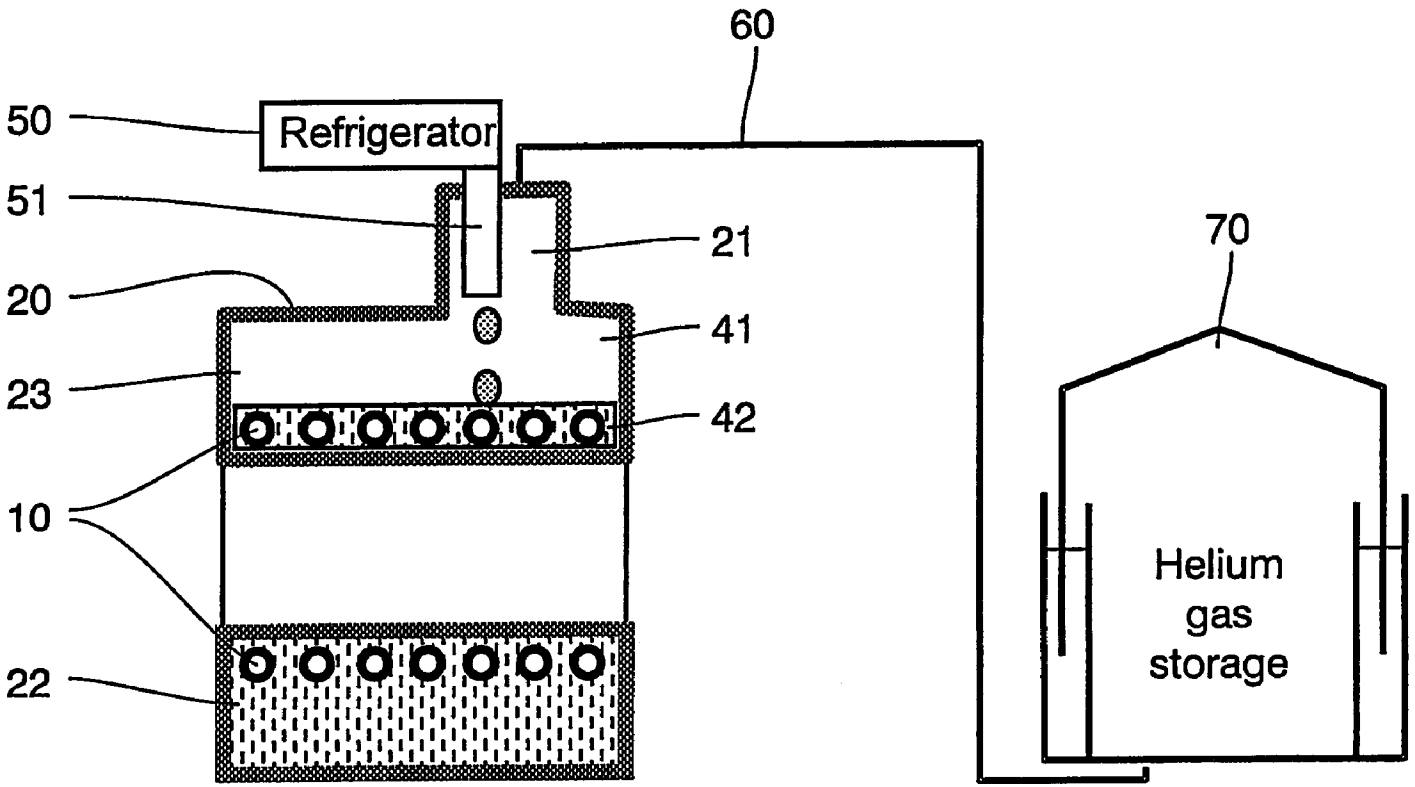

| | | | | |
|---|---|---|---|---|
| 6,107,905 | A * | 8/2000 | Itoh et al. | 335/216 |
| 6,363,727 | B1 * | 4/2002 | Hashimoto et al. | 62/6 |
| 6,622,494 | B1 * | 9/2003 | Pourrahimi | 62/51.1 |
| 6,781,492 | B2 * | 8/2004 | Takeshima et al. | 335/216 |
| 2001/0023592 | A1 | 9/2001 | Odawara et al. | |

FOREIGN PATENT DOCUMENTS

| | | | |
|---|---|---|---|
| JP | 6-251937 | A * | 9/1994 |
| JP | 8159584 | | 6/1996 |
| JP | 11325630 | | 11/1999 |
| JP | 2000274852 | | 10/2000 |

* cited by examiner

COOLING DEVICE FOR MR APPARATUS

This invention relates to a cooling device for cooling a superconducting coil assembly in an MR apparatus, comprising a cooling chamber adapted to contain a cooling agent which is in thermal contact with the superconducting coil assembly, a refrigerator for cooling the cooling agent and an MR apparatus with a respective cooling device. The invention also relates to a cooling method for cooling a superconducting coil assembly in an MR apparatus, wherein the superconducting coil assembly is cooled using a cooling agent which is in thermal contact with the superconducting coil assembly in a cooling chamber, the cooling agent being cooled by a refrigerator.

Cooling devices as described above are well known in the art, a description of which can be taken from U.S. Pat. No. 5,410,286. Such cooling devices are used for cooling down a superconducting coil assembly in order to achieve a low temperature at which the superconducting material of the coil assembly has superconducting properties. In this state, the coil is able, due to the absence of electrical resistance in the cold magnetic coils, to produce and maintain a strong magnetic field. Since an increase of temperature immediately leads to an increase in electrical resistance in the coil, which again induces heat and therefore leads to a further increase of temperature, it is essential to keep the temperature in the prescribed low range. Usually, the coils are enclosed in a cooling chamber filled with a liquid and/or gaseous cooling agent. The coils are preferably embedded in a liquid bath of the cooling agent, e.g. helium, having a temperature of around 4K at atmospheric pressure; this is appropriate for the superconducting materials commonly used in MRI magnets. To maintain the liquid helium at this cryogenic temperature, a refrigerator is used to compensate for heat transfer due to non-ideal isolation. Usually, the refrigerator is adapted to provide sufficient cooling power to allow zero-boil-off operation. In such zero-boil-off operation the refrigerator has a cooling capacity which is sufficient for cooling the helium in normal use in such a way that the temperature is kept within a prescribed range.

However, in given circumstances, irregularities may occur which can affect the cooling behavior of the cooling device. As such, the cooling efficiency might be lowered or even completely stopped due to defects, power breakdowns, leakages or other events leading to a partial or complete shut down of the refrigerator or to increased heat transfer into the cooling agent.

In times of such irregularities the temperature of at least parts of the cooling agent increases, resulting in an increase of pressure inside the cooling chamber. Consequently it is usually required to release helium from the cooling chamber, being only able to load a certain pressure inside. Consequently, a loss of helium occurs each time when such an irregularity happens. To assure that the coil is always embedded in liquid helium, a refill procedure has to take place at certain time intervals to compensate for this loss of helium. This refill procedure requires additional management efforts and leads to down times of the MR device. As a result, the efficiency of the device is lowered and operational costs increase.

Moreover, since the world's helium resources are limited, a loss of helium should be avoided.

Thus, it is the object of this invention to provide a cooling device with a reduced loss of cooling agent.

This object is achieved according to the invention by a cooling device as described in the preamble of claim 1, having a cooling agent storage in fluid connection with the cooling chamber, the storage being adapted to take up cooling agent from the cooling chamber when at least a part of the cooling agent in the cooling chamber exceeds a first predetermined temperature and to return cooling agent to the cooling chamber when at least a part of the cooling agent in the cooling chamber remains below or is equal to a second predetermined temperature.

The use of the proposed cooling agent storage allows storage of the cooling agent in operational conditions, in which it was usually blown off. A loss of cooling agent is thus avoided. Furthermore, the cooling device according to the invention allows immediate return of cooling agent to the cooling chamber as soon as the abnormal operational conditions have ended and the cooling device returns to normal operation. In such normal operational conditions the cooling capacity of the refrigerator usually allows cooling down of additional cooling agent, which is returned to the cooling chamber from the cooling agent storage at a temperature higher than that of the cooling agent in the cooling chamber itself.

The cooling device according to the invention provides a closed system in which the cooling agent can be transferred to the cooling agent storage in times of abnormal operational conditions which required a blow off of cooling agent in the state of the art. The cooling agent can be stored in the cooling agent storage at a temperature higher than the temperature of the cooling agent in the cooling chamber. As soon as the cooling device returns to normal operational conditions or additional cooling capacity is provided in the system, the cooling agent stored in the cooling agent storage can be transferred to the cooling chamber again and be cooled down to the temperature of the cooling agent which remained in the cooling chamber.

The cooling device is particularly advantageous when used in systems having a cooling capacity sufficient to be operated at zero boil-off. In such systems, an increase and decrease of the temperature of the cooling agent in at least a part of the cooling chamber will occur due to a difference of the cooling power introduced into the cooling chamber by the refrigerator and the sum of the heat transfer into the chamber and the heat induction in the chamber. For example, increased heat transfer due to a defective insulation or decreased cooling power will induce a temperature increase and the liquid cooling agent in the cooling chamber will turn to gas. This will immediately lead to a transfer of cooling agent to the cooling agent storage. A temperature increase in the whole cooing chamber is thus avoided. Conversely, the cooling agent will be retransferred as soon as the cooling power increases and exceeds the sum of the heat transfer into the cooling chamber and the heat induced in the cooling chamber, making the gaseous cooling agent in the cooling chamber condense on the cooling surface.

In a preferred embodiment according to the invention the cooling chamber is adapted to contain cooling agent in liquid and a gaseous condition and the fluid connection is connected to a part of the cooling chamber which is adapted to contain a gaseous cooling agent. This embodiment is particularly advantageous when the superconducting coil assembly is embedded in the liquid cooling agent, ensuring that the superconducting temperature of the coil material is maintained even in periods of abnormal operational conditions, such as failure of the refrigerator. Providing the fluid connection in a part of the cooling chamber containing gaseous cooling agent allows for the transfer of only gaseous cooling agent to the cooling agent storage and avoids the transfer of cryogenic, liquefied cooling agent. Thus, easy control of the pressure inside the cooling chamber is achieved and excessive loss of cooling agent, in particular liquid cooling agent, is avoided.

According to another preferred embodiment of the invention, means are provided for controlling the take up and return of the cooling agent by means of a signal derived from the pressure of the cooling agent in the cooling chamber.

The cooling agent contained in the cooling chamber according to the invention has a pressure higher than the surrounding atmosphere pressure, as it is well known from state of the art cooling devices. It is thus prevented that contaminants can be drawn into the cooling chamber from the ambient atmosphere. To maintain this higher pressure inside the cooling chamber, the cooling chamber is sealed from the ambient atmosphere. Abnormal working conditions, such as increased heat induction in the cooling chamber or lowered cooling capacity of the refrigerator, induce an expansion of the gaseous cooling agent and/or a transition of liquefied cooling agent into the gaseous condition. This induces a pressure increase inside the cooling chamber is induced, enabling the extraction of a signal to control take up and return of the cooling agent. Using this signal, a transfer of the cooling agent to the cooling agent storage and a return from the cooling agent storage to the cooling chamber can be easily controlled by the pressure of the cooling agent inside the cooling chamber.

In another preferred embodiment of the invention the refrigerator comprises a cooling surface in thermal contact with the cooling agent, the cooling surface extending into the cooling chamber, in particular into that part of the cooling chamber which is adapted to contain gaseous cooling agent. A simple arrangement of the refrigerator cooling the cooling agent within the cooling chamber is thus achieved. The embodiment also avoids multiple fittings required for other refrigerator arrangements in which the cooling agent has to be piped to an external cooling surface. As far as the cooling surface extends into the part of the cooling chamber containing gaseous cooling agent, a simple internal cooling cycle is achieved inside the cooling chamber, in which gaseous cooling agent is cooled down in a region around the cooling surface, thereby condensing on the cooling surface and dropping into the pool of liquid cooling agent.

In another preferred embodiment the cooling agent storage includes a gasometer for storing the cooling agent at a constant predetermined pressure. The use of a gasometer for storing the cooling agent allows simple and safe storage. A risk of explosion of the storage, as always exists when highly compressed medium is stored in a closed storage of constant volume, is avoided, since the gasometer is able to increase its storage volume according to the volume of the cooling agent introduced into the gasometer. Furthermore, in a similar fashion as in a storage of constant volume, cooling agent can be released from the storage when a certain amount of cooling agent inside the storage is exceeded.

According to another preferred embodiment of the invention the cooling agent storage comprises a pressure tank in fluid connection with the cooling chamber for taking up the compressed cooling agent, a compressor means interposed in a fluid connection between the cooling chamber and the pressure tank for compressing the cooling agent exiting the cooling chamber, and a pressure reduction means interposed in a fluid connection between the cooling chamber, and the pressure tank for reducing the pressure of the cooling agent returning to the cooling chamber. A space-saving cooling device is thus realized since the compression of the cooling agent and its storage in a pressure tank allow the storage of a large mass of cooling agent in a rather small space. The cooling agent can be compressed so far, that it reaches a liquid condition and can be stored in this liquid condition, so that a large mass of cooling agent is stored in a smaller space in comparison with the storage in a gasometer.

Since the cooling agent in the cooling chamber is usually at a pressure which is only slightly above the atmospheric pressure and the compressor means compress the cooling agent to a pressure well above the pressure of the cooling agent in the cooling chamber, it is necessary to reduce the pressure of the cooling agent before it is retransferred to the cooling chamber. The pressure reduction means for achieving this pressure reduction could be, for example, a valve or throttle.

In another preferred embodiment of the invention the cooling agent storage is adapted to contain the cooling agent in a gaseous condition. This embodiment is preferred when a safe and cost-effective storage is needed. Storing the cooling agent in a gaseous condition allows storage at atmospheric pressure or slightly above this pressure and at room temperature or temperatures below but close to room temperature.

Finally, in a last preferred embodiment the cooling chamber and the cooling agent storage are adapted to contain helium as the cooling agent. Helium is particularly useful for use as cooling agent, since helium has a temperature of around 4K (4° above absolute zero) in the liquid/gaseous condition at atmospheric pressure (approx. 1013 mbar) or slightly above atmospheric pressure. This temperature is sufficient to cool a variety of superconducting materials to a temperature at which they have superconducting properties.

Another aspect of the invention is a cooling method for cooling a superconducting coil assembly in a MR apparatus, wherein the superconducting coil assembly is cooled using a cooling agent which is in thermal contact with the superconducting coil assembly in a cooling chamber, the cooling agent being cooled by a refrigerator, the method comprising the steps of transferring cooling agent from the cooling chamber to a cooling agent storage when a predetermined temperature is exceeded in at least a part of the cooling agent in the cooling chamber and returning cooling agent from the cooling agent storage to the cooling chamber when the temperature of at least a part of the cooling agent in the cooling chamber is equal to or less than the predetermined temperature.

The cooling method according to the invention allows safe cooling of a superconducting coil assembly without loss of cooling agent in times of abnormal operational conditions. The cooling agent is kept within a closed system. The cooling method according to the invention can easily be performed by means of known cooling devices when they are additionally equipped with a cooling agent storage as described in the characterizing part of claim 1. This allows an effective way of cooling superconducting magnets in existing MR apparatus.

The cooling method according to the invention can be further improved when the cooling agent is in a gaseous and a liquid condition in the cooling chamber and the transfer and return of the cooling agent in the gaseous condition is controlled by means of a signal derived from the pressure of the cooling agent inside the cooling chamber and the cooling agent is transferred from the cooling chamber to the cooling agent storage when a first predetermined pressure is exceeded in the cooling chamber and the cooling agent is returned from the cooling agent storage to the cooling chamber when the pressure of the cooling agent in the cooling chamber is equal to or less than a second predetermined pressure.

This embodiment of the cooling method is particularly advantageous since usually the cooling agent is contained in a closed cooling chamber at a first pressure above but close to atmospheric pressure. Even a small temperature increase in parts of the cooling agent then leads to a pressure increase inside the closed cooling chamber. This pressure increase allows for easy detection of a partially temperature increase. As soon as the respective parts of the cooling agent are cooled to the desired, predetermined temperature or below this temperature, the pressure inside the cooling chamber returns to the respective second predetermined pressure or drops below this pressure. In this situation, cooling agent can be retransferred to the cooling chamber so as to compensate the aforementioned loss of cooling agent. The first and the second predetermined pressure may lie at the same pressure level.

In another preferred embodiment of the cooling method according to the invention the transferred cooling agent is compressed so as to be stored in a compressed state outside the cooling chamber and decompressed so as to be returned to the cooling chamber. This embodiment allows for space-saving storage of the cooling agent, since a large mass of cooling agent can be stored in a small space when it is compressed prior to being introduced into the storage. Since the cooling chambers of most MR apparatuses are arranged to operate at pressures close to atmospheric pressure, decompression of the cooling agent is required before it can be retransferred to the cooling chamber. Compression could be achieved by a fan or blower. To achieve higher compression rates, a compressor or even a condenser can be used. Decompression could be achieved by a valve or throttle and has to be performed in a way that it is adapted to the rate of compression inside the storage in relation to the pressure inside the cooling chamber. It has to be assured that the decompression is performed in a way that a predetermined pressure, usually being close to atmospheric pressure, inside the cooling chamber is not exceeded when the cooling agent is returned.

Another aspect of the invention is an MR apparatus, comprising a superconducting magnet having a superconducting coil assembly and a cooling device as described above for cooling said superconducting coil assembly.

Figure 2:
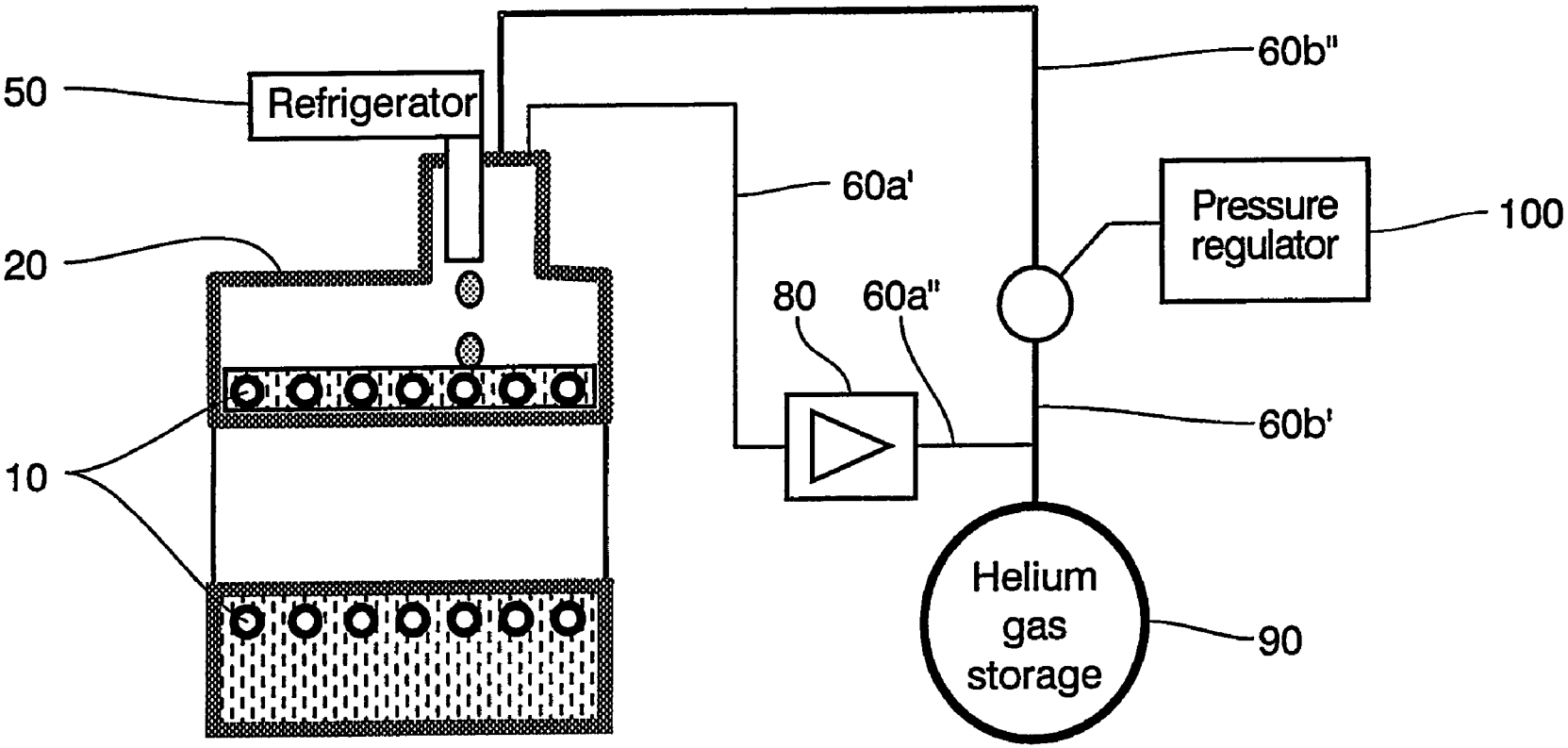
Figure 3:
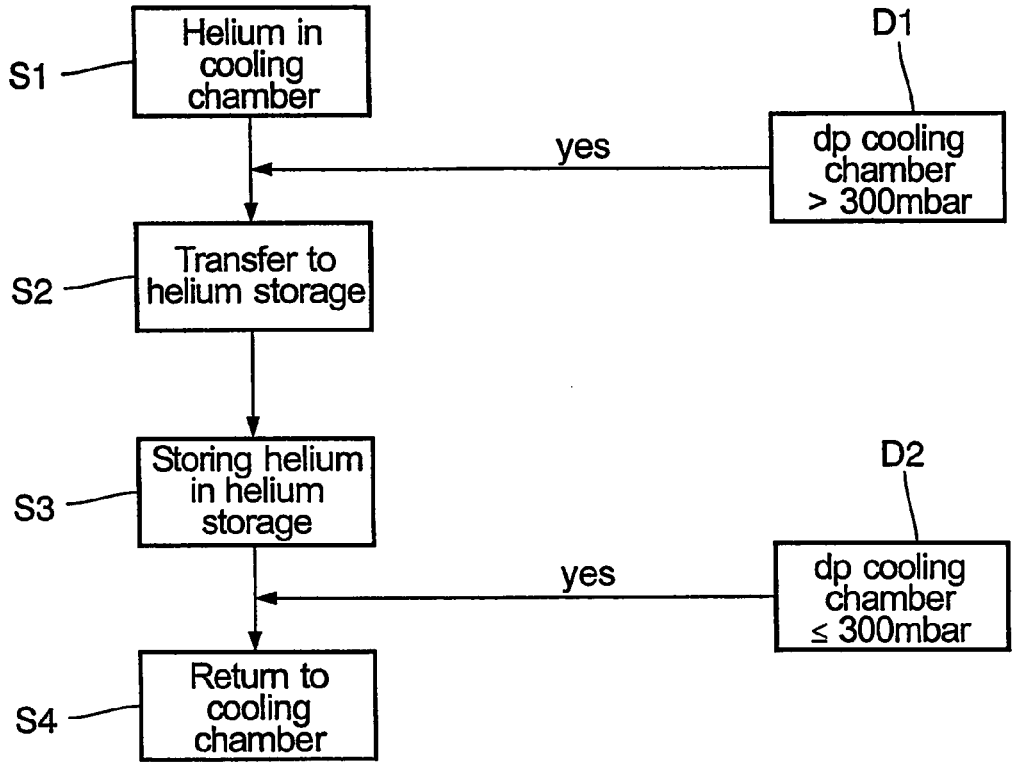
Figure 4:
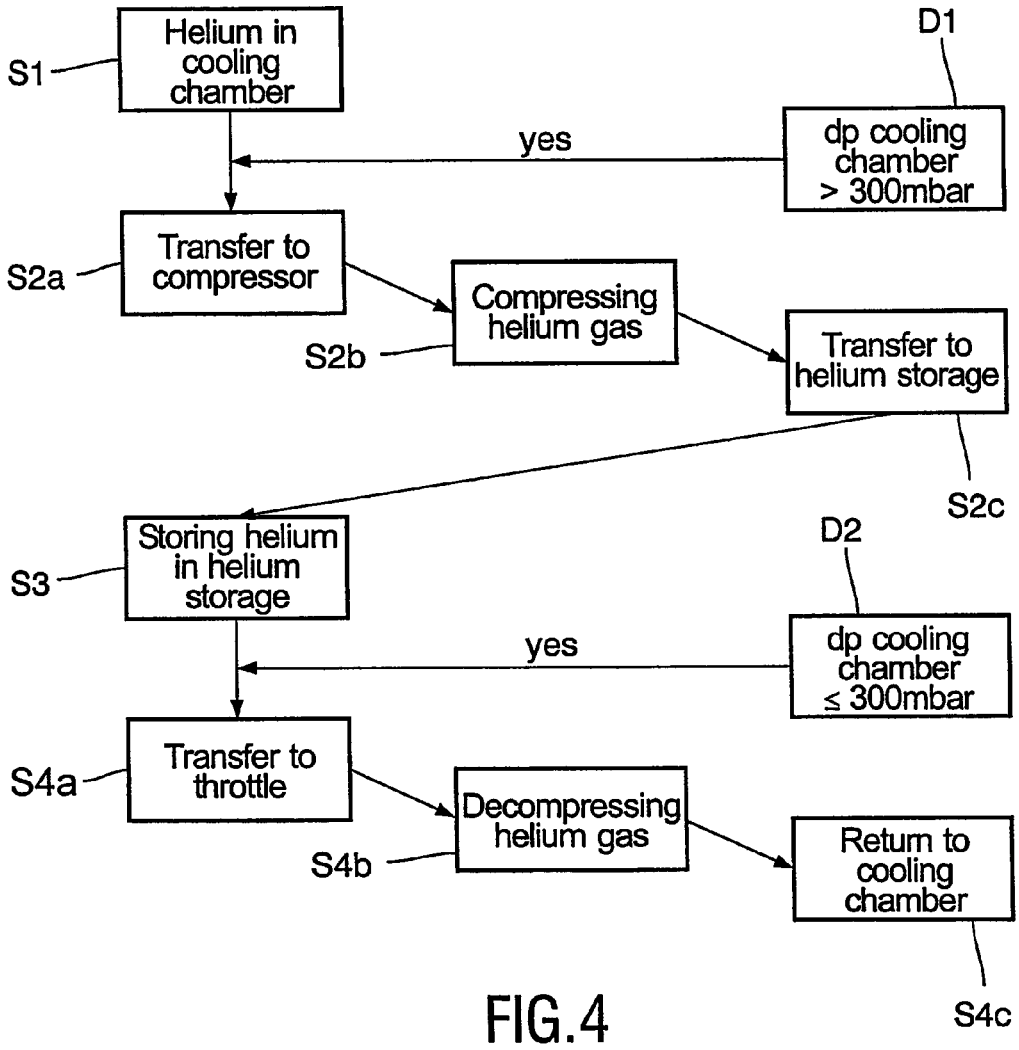

Preferred embodiments of the invention will now be explained with reference to the accompanying figures, wherein FIG. 1 is a schematic representation of a first embodiment according to the invention, FIG. 2 is a schematic representation of a second embodiment according to the invention, FIG. 3 is a flow chart of a first preferred embodiment of the cooling method according to the invention, and FIG. 4 is a flow chart of a second preferred embodiment of the cooling method according to the invention.

Referring to FIG. 1, a first embodiment of the invention comprises an MR imaging device having a superconducting coil assembly 10 arranged inside a cylindrical cooling chamber 20. The coil assembly 10 and the cooling chamber 20 are shown in a cross-sectional view in FIG. 1. The cylindrical cooling chamber 20 surrounds a cylindrical examination space arranged to accommodate a person to be examined with the aid of the MRI device.

The cylindrical cooling chamber 20 comprises a dome 21 disposed at the upper side of the cooling chamber 20. The cooling chamber 20 is filled with helium in liquid (41) and gaseous (42) condition. The amount of the helium in liquid condition 41 is such that the coil assembly 10 is completely immersed in the liquid helium 41. The lower part 22 of the cylindrical cooling chamber 20 is completely filled with liquid helium, whereas in the upper part 23 of the cooling chamber 20 a certain level of liquid helium is reached and above this level gaseous helium 42 is present.

The dome 21 is arranged in such a way that gaseous cooling agent is collected therein. Due to well-known physical effects and properties of fluids like this gaseous helium, in particular that amount of gaseous helium is collected in the dome which has a temperature lying above the temperature of the liquid helium and the gaseous helium in the upper part 23 of the cooling chamber 20.

A refrigerator 50 is arranged in the vicinity of the cooling chamber 20. The refrigerator 50 comprises a cooling surface 51 extending into the dome 21 of the cooling chamber 20. The temperature of the cooling surface 51 is controlled in such a way that it lies below the temperature which is required in the cooling agent to achieve the superconducting properties of the coil assembly 10. For example, when a liquid helium temperature of approximately 4K is sufficient for achieving superconducting properties of the coil assembly 10, the temperature of the cooling surface 51 might be 3.8K However, a temperature of 4.2 to 4K of the liquid helium 41 is sufficient for most superconducting materials. Gaseous cooling agent above approx. 4.2K condenses on the cooling surface 51 and drops back into the pool of liquid helium 41 due to gravity.

In the upper part of the dome 21 a first gas conduit 60 is attached by way of a first end fitting which opens into the cooling chamber 20. The second end fitting of the gas conduit 60 is connected to a gasometer 70. In the gasometer 70 helium is stored at a pressure of approximately 300 mbar above atmospheric pressure.

The arrangement according to FIG. 1 provides for automatic transfer and retransfer of gaseous helium between the cooling chamber 20 and the gasometer 70 through the gas conduit 60. The transfer and the retransfer are automatically controlled by the pressure in the cooling chamber which is kept constant at approximately 300 mpa above atmospheric pressure. In times the cooling capacity of the refrigerator goes beyond the heat transfer into the cooling chamber, an immediate transfer of cooling agent to the gasometer is thus achieved by way of a leveling out of the pressure inside the cooling chamber and the pressure inside the gasometer.

FIG. 2 shows a second embodiment of the cooling device according to the invention. The embodiment of FIG. 2 is similar to that of FIG. 1 in respect of the coil assembly 10, the cooling chamber 20, the refrigerator 50 and the cooling agent 41, 42 inside the cooling chamber 20. Identical parts of FIGS. 1 and 2 are labeled with identical reference numerals, a detailed description of which is omitted below.

As opposed to the embodiment of FIG. 1, the embodiment of FIG. 2 is provided with two gas conduits 60*a'*, *a"*, *b'*, *b"*. A first part of the first gas conduit 60*a'* is connected to the upper part of the dome 21 and is arranged for transferring gaseous helium to a compressor 80. The compressor 80 is designed to compress the gaseous helium to a pressure of approximately 100 bar. The compressed helium is stored in a compression-proof storage 90. For this purpose, a second part of the first gas conduit 60*a"* connects the pressure side of the compressor 80 to the helium gas storage 90.

A second gas conduit 60*b'*, *b"* serves for retransferring helium gas from the helium gas storage 90 to the cooling chamber 20. In particular, the helium gas storage 90 is connected to a pressure regulator 100 via a first part of a second gas conduit 60*b'*.

The pressure regulator 100 throttles the helium gas to a pressure of approximately 300 mbar above atmospheric pressure. The pressure regulator 100 is connected to the upper part of the dome 21 via a second part of the second gas conduit 60*b*". Throttled helium gas can thus be retransferred from the helium gas storage 90 to the cooling chamber 20 via the pressure regulator 100.

The helium gas thus returned will usually have a temperature above the temperature of the helium gas inside the cooling chamber. Since the returned helium gas is introduced into the dome close to the cooling surface 51 of the refrigerator, this gas is immediately cooled down and condenses on the cooling surface 51, thereby reaching the temperature required for cooling the superconducting coil assembly 10.

The pressure regulator 100 is adapted to open and close the second gas conduit 60*b', b"* in dependence on the gas pressure in the second part of the second gas conduit 60*b*" which corresponds to the gas pressure inside the dome 21.

Furthermore, the pressure regulator 100 is adapted to activate or deactivate the compressor 80 in dependence on this pressure signal. For example, when a certain pressure, for example 320 mbar above atmospheric pressure, is exceeded in the second part of the second gas conduit 60*b*", or the dome 21, the compressor 80 is activated. As soon as the pressure drops below a second predetermined value, for example 300 mbar above atmospheric pressure, the compressor 80 is deactivated. As soon as the pressure drops below a third predetermined value, for example 280 mbar above atmospheric pressure, the pressure regulator opens the second gas conduit 60*b*, thereby retransferring helium gas to the cooling chamber.

It should be noted that the pressure in the dome 21 corresponds to the pressure in the first part of the first gas conduit 60*a'* as well and, therefore, the pressure signal could alternatively be taken from this part.

Referring now to FIG. 3, in a preferred embodiment of the cooling method according to the invention a cooling agent is contained in a cooling chamber in a first step S1. When this helium cooling agent exceeds a pressure difference of 320 mbar, for example, above the atmospheric pressure in decision D1, a part of said helium is transferred to a helium storage in a step S2. In this helium storage it is stored in a step S3 until it is determined in D2 that, for example, the pressure difference between the cooling chamber and the atmosphere is below or equal to 280 mbar. As soon as this condition is fulfilled, a part of the helium stored in the storage is returned to the cooling chamber in a step S4.

Alternatively, the cooling chamber and the helium storage can be connected by way of a respective pipe, allowing an exchange of gaseous cooling agent and keeping the pressure in the cooling chamber and the helium storage at equal levels at all times. The transfer and the retransfer of the helium can thus be easily performed, without any control means, simply by way leveling out the pressure inside the connected volumes of the cooling chamber and the helium storage.

Referring now to FIG. 4, showing a second preferred embodiment of the cooling method according to the invention, in similar steps S1 and decision D1 the cooling agent is stored and a decision is made in dependence on the pressure difference between the cooling chamber and the atmosphere. If the condition of D1 is fulfilled, the cooling agent is transferred to a compressor in a step S2*a* Afterwards, the cooling agent is compressed to a maximum pressure of 100 bar above atmospheric pressure in a step S2*b* and transferred to the cooling agent storage in a step S2*c*.

Similar to the embodiment of FIG. 3, the cooling agent is stored in the storage in a step S3 and depending on a decision D2 which is similar to FIG. 3, it is transferred to a throttle in a step S4*a*. In this throttle, the cooling agent is decompressed to a pressure of 300 mbar above atmospheric pressure in a step S4*b* and afterwards returned to the cooling chamber in a step S4*c*.

The invention provides a cooling device for MR apparatus, in particular for apparatus adapted for zero boil-off operation, which is arranged to avoid any release of cooling agent, even if the cooling power of the refrigerator of the cooling device decreases and the heat transfer into the cooling chamber lasts for a longer time period. Costs due to the need for refilling cooling agent can thus be saved. The limited resources of commonly used cooling agents, such as helium, are not wasted. The method according to the invention allows for efficient use of cooling agents and can be applied in known MR apparatus as well as in newly designed MR apparatus, without necessitating the addition of expensive equipment.

The invention claimed is:

1. A cooling device for cooling a superconducting coil assembly in an MR apparatus, comprising:

a cooling chamber adapted to contain a cooling agent which is in thermal contact with the superconducting coil assembly, a refrigerator for cooling the cooling agent, and a cooling agent storage in fluid connection with the cooling chamber, the cooling agent storage being adapted to take up cooling agent from the cooling chamber when at least a part of the cooling agent in the cooling chamber exceeds a first predetermined temperature, and to return cooling agent to the cooling chamber when at least a part of the cooling agent in the cooling chamber remains below or is equal to a second predetermined temperature, the cooling agent storage including a pressure tank in fluid connection with the cooling chamber for taking up the compressed cooling agent and a compressor means interposed in a fluid connection between the cooling chamber and the pressure tank in order to compress the cooling agent exiting the cooling chamber.

2. A cooling device according to claim 1, wherein the cooling chamber is adapted to contain a cooling agent in a liquid and a gaseous condition and the fluid connection is connected to a part of the cooling chamber which is adapted to contain a gaseous cooling agent.

3. A cooling device according to claim 1, wherein the refrigerator has a cooling power sufficient to compensate heat transfer to the cooling chamber in regular condition so as to allow zero boil-off operation.

4. A cooling device according to claim 1, comprising means for controlling the take up and return of the cooling agent by means of a signal derived from the pressure of the cooling agent in the cooling chamber.

5. A cooling device according to claim 1, wherein the refrigerator comprises a cooling surface in thermal contact with the cooling agent, the cooling surface extending into the cooling chamber, in particular into that part of the cooling chamber which is adapted to contain a gaseous cooling agent.

6. A cooling device according to claim 1, wherein the cooling agent storage includes a gasometer for storing the cooling agent at a constant predetermined pressure.

7. A cooling device according to claim 1, wherein the cooling agent storage comprises a pressure reduction means interposed in a fluid connection between the cooling chamber and the pressure tank in order to reduce the pressure of the cooling agent returning to the cooling chamber.

8. A cooling device according to claim 1, wherein the cooling agent storage is adapted to contain the cooling agent in a gaseous condition.

9. A cooling device according to claim 1, wherein the cooling chamber and the cooling agent storage are adapted to contain helium as a cooling agent.

10. A cooling method for cooling a superconducting coil assembly in an MR apparatus, wherein the superconducting coil assembly is cooled using a cooling agent which is in thermal contact with the superconducting coil assembly in a cooling chamber, the cooling agent being cooled by a refrigerator, the method comprising the steps of:

transferring cooling agent from the cooling chamber to a cooling agent storage when a predetermined temperature is exceeded in at least a part of the cooling agent in the cooling chamber, and returning cooling agent from the cooling agent storage to the cooling chamber when the temperature of at least a part of the cooling agent in the cooling chamber is equal to or less than the predetermined temperature, wherein the transferred cooling agent is compressed so as to be stored in a compressed state outside the cooling chamber and decompressed so as to be returned to the cooling chamber.

11. A cooling method according to claim 10, wherein the cooling agent is in a gaseous and a liquid condition in the cooling chamber and the transfer and return of the cooling agent in the gaseous condition is controlled by means of a signal derived from the pressure of the cooling agent inside the cooling chamber, and the cooling agent is transferred from the cooling chamber to the cooling agent storage when a first predetermined pressure is exceeded in the cooling chamber, and the cooling agent is returned from the cooling agent storage to the cooling chamber when the pressure of the cooling agent in the cooling chamber is equal to or less than a second predetermined pressure.

12. An MR apparatus comprising:

a superconducting magnet having a superconducting coil assembly; and a cooling device for cooling said superconducting coil assembly, the cooling device comprising:

a cooling chamber adapted to contain a cooling agent which is in thermal contact with the superconducting coil assembly, a refrigerator for cooling the cooling agent, a pressure tank in fluid connection with the cooling chamber for taking up the compressed cooling agent and returning cooling agent to the cooling chamber in accordance with temperature in the cooling chamber, and a compressor interposed in a fluid connection between the cooling chamber and the pressure tank in order to compress the cooling agent exiting the cooling chamber.

13. An MR apparatus according to claim 12, further including a pressure reducer interposed in a fluid connection between the cooling chamber and the pressure tank in order to reduce the pressure of the cooling agent returning to the cooling chamber.

* * * * *